US005808518A

United States Patent [19]

McKinzie, III et al.

[11] Patent Number: 5,808,518

[45] Date of Patent: Sep. 15, 1998

[54] PRINTED GUANELLA 1:4 BALUN

[75] Inventors: William Edward McKinzie, III, Berwyn Heights, Md.; Tracy Lynn Anderson, Whittier, Calif.

[73] Assignee: Northrop Grumman Corporation, Los Angeles, Calif.

[21] Appl. No.: 739,247

[22] Filed: Oct. 29, 1996

[51] Int. Cl.[6] ..... H01P 5/10

[52] U.S. Cl. ..... 333/26; 29/600

[58] Field of Search ..... 333/26; 343/821, 343/859; 29/600

[56] References Cited

U.S. PATENT DOCUMENTS

| | | | |
|---|---|---|---|
| 3,614,694 | 10/1971 | Koontz | 336/26 |
| 3,678,418 | 7/1972 | Woodward | 333/26 |
| 3,784,933 | 1/1974 | Scherer et al. | 333/26 |
| 3,835,421 | 9/1974 | De Brecht et al. | 333/26 |
| 3,846,721 | 11/1974 | Fritz et al. | 333/26 |
| 3,976,959 | 8/1976 | Gaspari | 333/26 |
| 3,991,390 | 11/1976 | Conroy | 333/26 |
| 4,460,877 | 7/1984 | Sterns | 333/26 |
| 4,495,505 | 1/1985 | Shields | 343/821 |
| 4,737,797 | 4/1988 | Siwiak et al. | 343/859 |
| 4,739,289 | 4/1988 | Cripps | 333/26 |
| 4,800,393 | 1/1989 | Edward et al. | 343/821 |
| 4,862,189 | 8/1989 | Morgan | 343/859 |
| 4,882,553 | 11/1989 | Davies et al. | 333/26 |
| 4,980,654 | 12/1990 | Moulton | 333/12 |
| 5,025,232 | 6/1991 | Pavio | 333/26 |
| 5,061,910 | 10/1991 | Bouny | 333/26 |
| 5,121,090 | 6/1992 | Garuts et al. | 333/124 |
| 5,148,130 | 9/1992 | Dietrich | 333/25 |
| 5,172,082 | 12/1992 | Livingston et al. | 333/26 |
| 5,379,006 | 1/1995 | McCorkle | 333/26 |

*Primary Examiner*—Paul Gensler

*Attorney, Agent, or Firm*—Terry J. Anderson; Karl J. Hoch, Jr.

[57] ABSTRACT

A Guanella 1:4 balun is made capable of handling frequencies in the gigahertz range by printing its transmission lines on a microwave laminate. The resulting balun has a largest dimension substantially smaller than one free space wavelength throughout a 20:1 usable frequency range.

4 Claims, 5 Drawing Sheets

PRINTED GUANELLA 1:4 BALUN

FIELD OF THE INVENTION

This invention relates to microwave antenna feeds, and more particularly to a compact balun of the Guanella 1:4 type.

BACKGROUND OF THE INVENTION

In the field of microwave transmission, it is often desirable to achieve as broad a bandwidth as possible to efficiently transmit signals varying widely in frequency. Usually, the limiting factor in microwave antenna systems is the antenna feed which must impedance-match an unbalanced microwave cavity or line output to a balanced element such as a spiral antenna.

A number of antenna feed balun designs have been proposed over the years. A popular design is the Guanella 1:4 balun, which uses a pair of mutually interconnected transmission line transformers to match a generator impedance of R to a load impedance of 4R. The typical Guanella balun consists of two pairs of twisted leads, each pair being wrapped around or threaded through one or more ferrous toroids or rods which form the cores of the transformers.

Guanella transformers typically exhibit high power handling capabilities (e.g. tens to hundreds of watts continuous power at HF frequencies) due to the fact that RF power flows by way of transmission line modes and not by the coupling of magnetic flux lines. The ferrite cores are used only for choking common mode electrical curents. However, even the more recently introduced linear design mentioned above, in which the twin leads are run straight through the ferrite beads or cores, typically demonstrates low insertion loss from about 20 MHz to 100 MHz but is not efficiently operable at frequencies higher than 100 MHz.

In airborne applications, it is often necessary to not only obtain the maximum possible bandwidth from a microwave system, but also to do so with the smallest and lightest system obtainable. For this reason, aircraft antenna installations for communications, navigation and identification (CNI), electronic support measures (ESM) and electronic countermeasures (ECM) applications commonly use flush mounted cavities operating in the gigahertz range. It would be desirable to integrate a balun directly into such cavities, but the conventional Guanella baluns are too large for that purpose.

SUMMARY OF THE INVENTION

The present invention specifically addresses and alleviates the above mentioned deficiencies associated with the prior art. More particularly, the present invention comprises a printed linear Guanella 1:4 balun which is small enough to fit into flush mounted cavities, and which exhibits satisfactory performance properties up to 10 GHz. More specifically, the below-described embodiment of the invention was found to have a voltage standing wave ratio (VSWR) of less than 1.5:1 up to 2 GHz, and less than 2:1 up to 10 GHz. The signal loss attributable to the inventive balun was as little as 1 db at 1 GHz and 2 db at 2 GHz for each output. The amplitudes of each output were within 1 db of each other over most of the entire 2 GHz bandwidth, and the relative phase difference between the outputs varied by only 4 degrees from the 180° norm over the entire range from 0.3 to 2 GHz.

The foregoing performance is achieved in a balun measuring only about 66 mm×7½mm×23 mm (i.e. much less than a free-space wavelength over the entire 20:1 or more frequency bandwidth extending from VHF to L-band frequencies for which CNI, ESM and ECM equipment is often designed) by providing a printed microwave laminate to construct all of the balanced and unbalanced transmission lines of the balun. A balanced microstrip transmission line is fed through the center of the ferrite beads which are conventionally used to choke common mode currents.

These, as well as other advantages of the present invention will be more apparent from the following description and drawings. It is understood that changes in the specific structure shown and described may be made within the scope of the claims without departing from the spirit of the invention.

DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and the sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
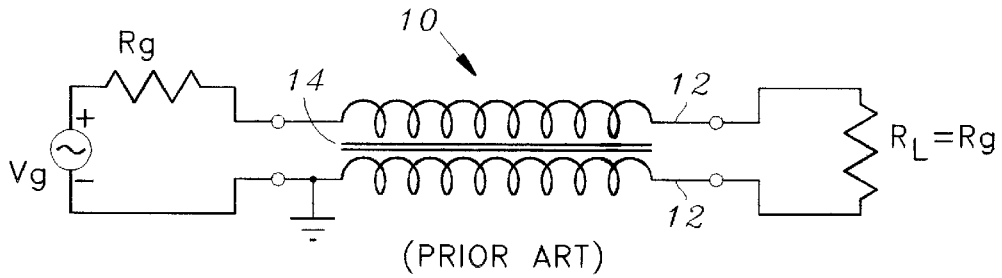
(PRIOR ART) FIG. 1
FIG. 1 is a circuit diagram illustrating a Guanella microwave transmission transformer.

FIG. 1 shows the general principle of a Guanella microwave transmission line transformer 10 in which the two leads of the transmission line 12 wind around, or threaded through a ferrite core 14 induce signals in each other. As previously stated herein, Guanella transformers typically exhibit high power handling capabilities because RF power flows via transmission line modes and not via the coupling of magnetic flux lines. The ferrite is used only to choke common mode electrical currents. In the arrangement of FIG. 1, the input impedance Rg of the transmission line 12 equals the output or load impedance $R_L$.

Figure 2:
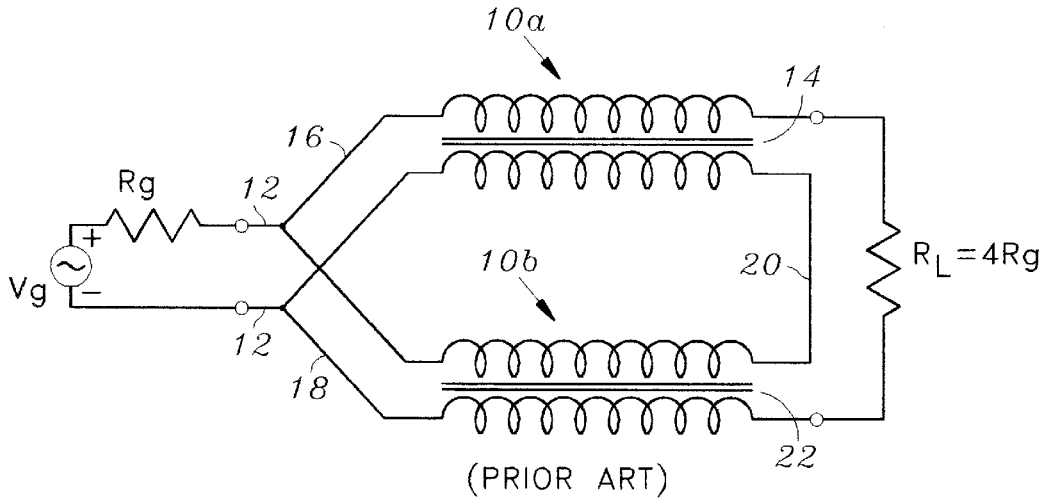
(PRIOR ART) FIG. 2
FIG. 2 is a circuit diagram illustrating a Guanella 1:4 transformer.

An extension of this principle is the 1:4 Guanella transformer shown in FIG. 2. In that arrangement, the transmission line 12 is split into two lines 16 and 18 which are associated with cores 14, 22, respectively, and are cross-connected at 20 to form a pair of transformers 10*a*, 10*b*. The load impedance $R_L$ in a thus connected transmission line is four times the input impedance Rg.

Figure 3:
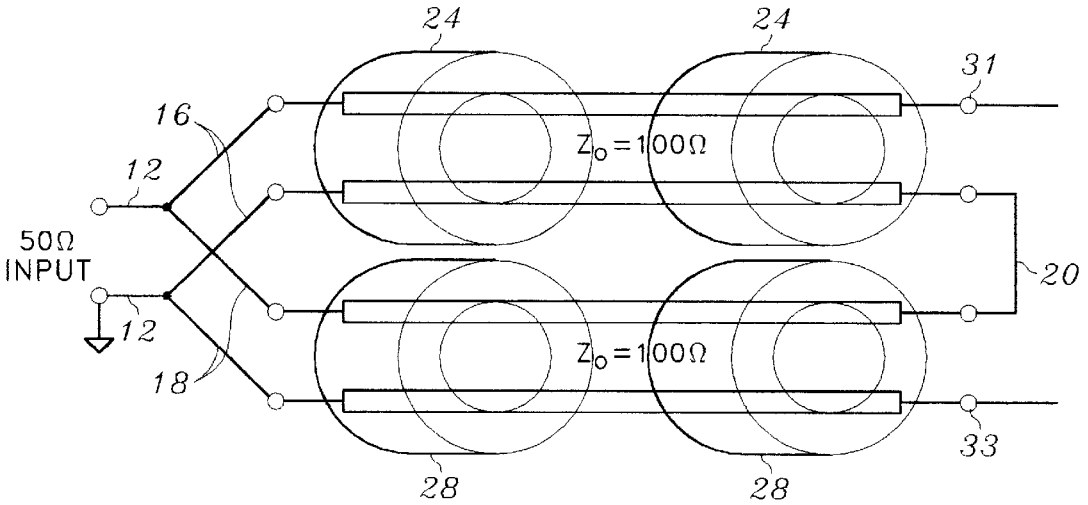
FIG. 3 is a schematic diagram illustrating the electrical layout of the inventive balun.

The physical structure of a balun using a 1:4 Guanella transformer is shown in FIG. 3. A pair of transmission lines 16, 18 are threaded, respectively, through ferrite beads 24 and 28. The characteristic impedance $Z_0$ of each line may be, for example 100 Ω, and they are connected in parallel so that the input impedance into line 12 is 50 Ω. The output at terminals 31, 33 of the balun of FIG. 3 is designed to feed into a balanced 200 Ω load such as a broadband balanced spiral antenna.

Figure 4A:
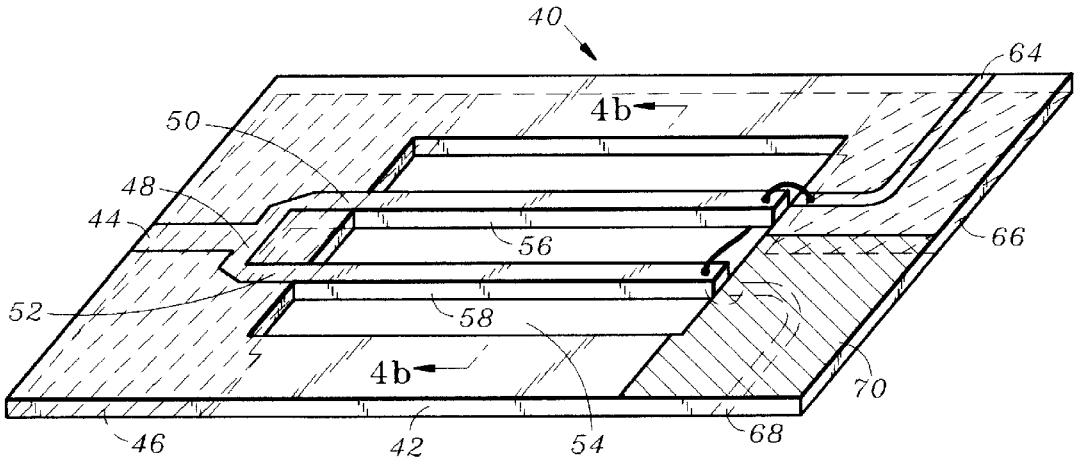
FIG. 4*a* is a top plan view, and FIG. 4*b* a bottom plan view, of the inventive balun.
Figure 4B:
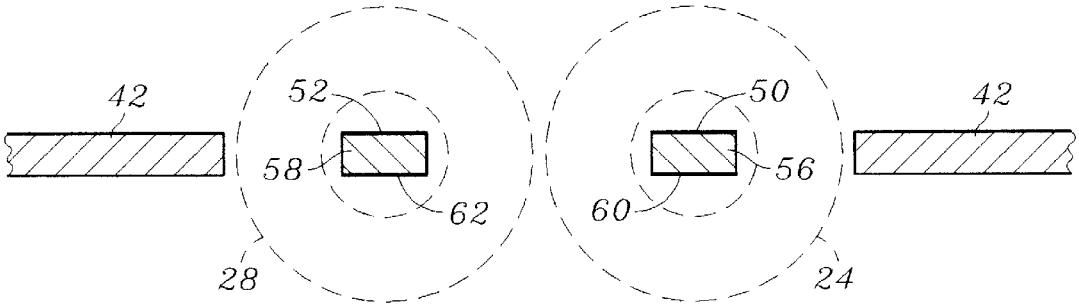

FIGS. 4*a* and 4*b* show the details of the balun 40 of this invention.

In FIG. 4*a*, the balun 40 is shown with the ferrite beads 24, 28 omitted for clarity. The balun 40 is formed by printed circuit technology on a substrate 42. The substrate 42 is preferably composed of a soft material with a low dielectric loss tangent, such as commercially available RT 5880 Duroid. The material of substrate 42 needs to be soft enough to allow bending of the cantilevered substrate section for the insertion of the ferrite beads as hereinafter described.

On the left side of FIG. 4*a*, it will be seen that a 50 Ω microstrip transmission line 44 is printed on the upper surface of the substrate 42. The bottom surface underlying the line 44 carries a local ground plane 46 which constitutes the second conductor of the transmission lines on the upper surface of the substrate 42.

At the junction 48, the line 44 splits into two 100 Ω lines 50, 52. These lines extend across the central opening 54 of the substrate 42 on cantilevered substrate strips 56, 58 which carry the lines 50, 52 on their upper side, and extensions 60, 62 (FIG. 4*b*) on their underside. The outer ends of the cantilevered strips 56, 58 are spaced from the right side (in FIG. 4*a*) of the balun 40.

On the top right side of balun 40, a 100 Ω microstrip 64 is printed on the upper side of substrate 42, while a ground plane 66 underlying the microstrip 64 is formed on the underside of substrate 42. On the bottom half (in FIG. 4*a*) of the right side of balun 40, a 100 Ω microstrip 68 is printed on the underside of substrate 42 while a ground plane 70 is formed on the upper side of substrate 42.

In the manufacturing process of the balun 40, the cantilevered strips 56, 58 are originally left unconnected. Their free ends are then bent upward, and the toroidal ferrite beads 24, 28 are slipped over them. Once the ferrite beads 24, 28 are in place, the strips 56, 58 are bent back into the plane of substrate 42. Conductor 50 is then connected to microstrip 64, and conductor 62 is connected to microstrip 68, by conducting bond wire or ribbon. Likewise, conductor 52 is connected to conductor 60.

Figure 5:
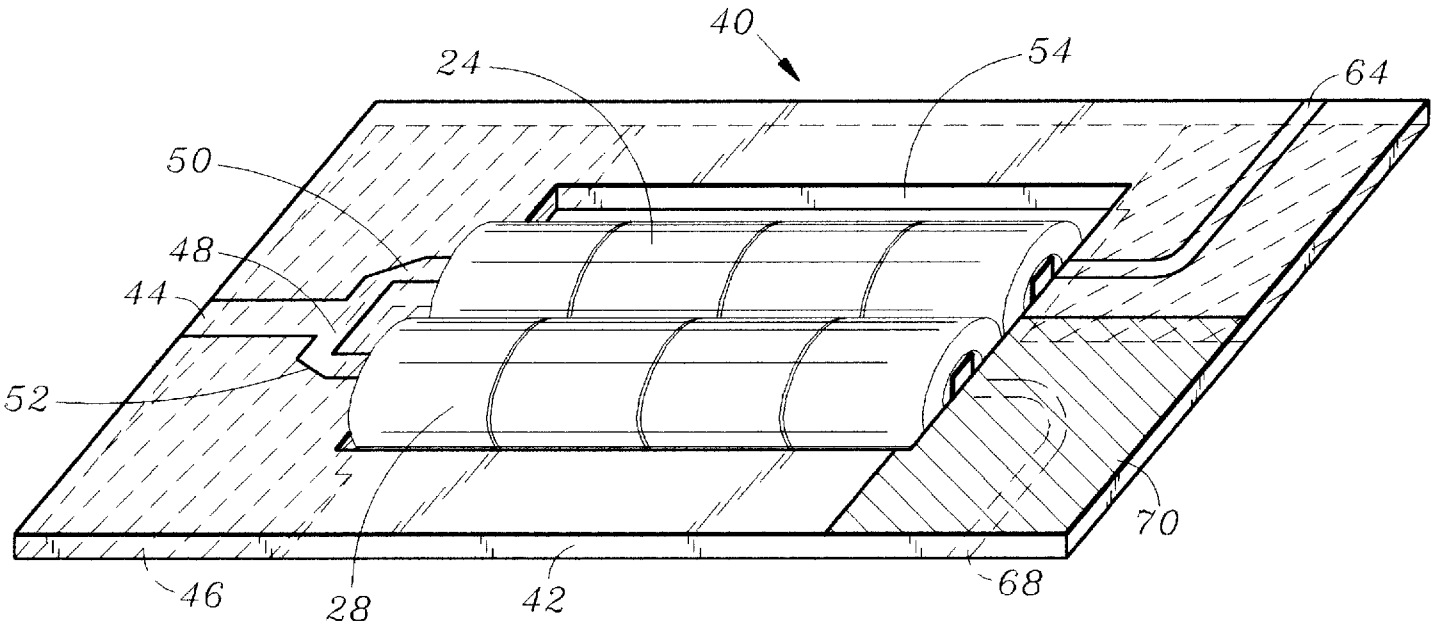
FIG. 5 is a perspective view of the balun of this invention.

As shown in FIG. 5, line 44 is connected to the unbalanced input port 12 (FIG. 3), while lines 64 and 68 are connected to the balanced output ports 31, 33 (FIG. 3) respectively.

The benefits of using the above-described printed circuit as opposed to the twisted twin leads of the prior art are twofold: for one, the uniformity of the transmission lines is closely controllable, and for another, printed transmission lines can be made physically smaller than twin leads and can be fabricated easily at relatively low cost.

Because of its size and uniformity, the printed circuit approach of this invention allows the Guanella balun concept to be extended from the previously possible less-than-100 MHz range into microwave frequencies up to the 10 GHz range. Specifically, as shown in FIGS. 6*a* and 6*b*, the voltage standing wave ratio (VSWR) at the 50 Ω input of a prototype embodiment of the invention was measured at no more than 1.5:1 up to about 4 GHz, and remained below 2:1 all the way to about 10 GHz.

Figure 6A:
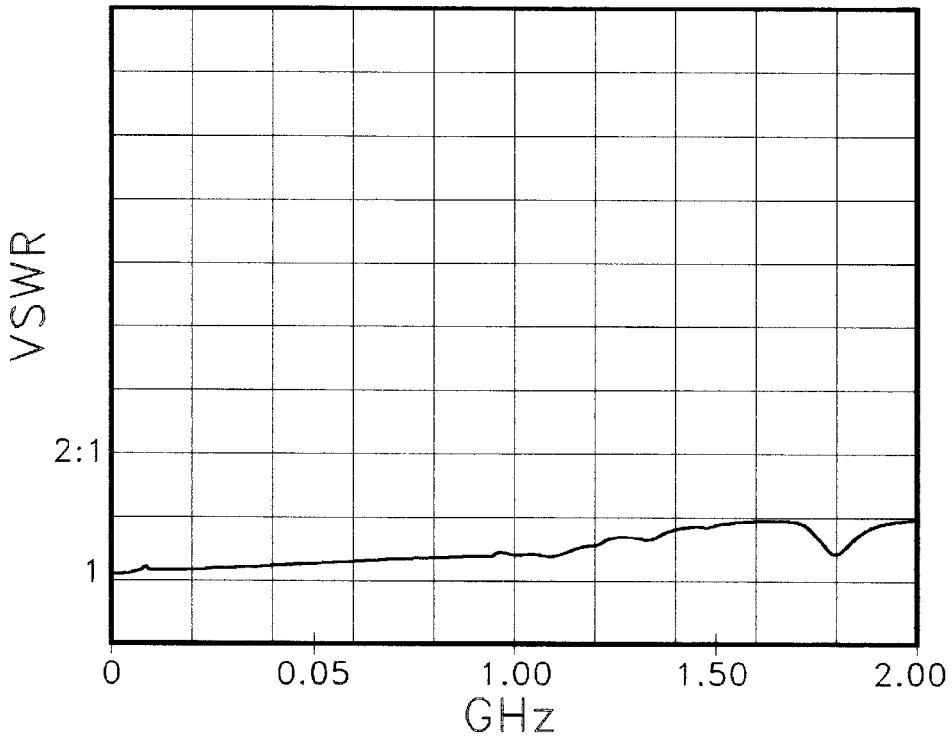
FIGS. 6*a* and 6*b* are frequency-amplitude diagrams showing the measured voltage standing wave ratio of a preferred embodiment of the invention for the 0.05 to 2 GHz and 0.09 to 18 GHz ranges, respectively.
Figure 6B:
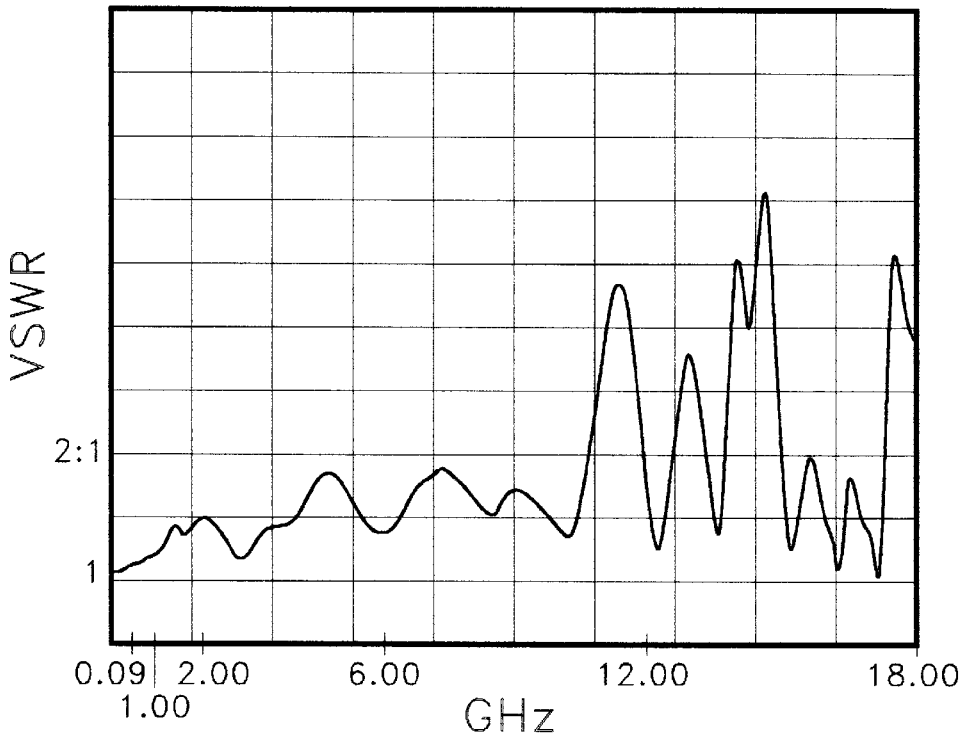
Figure 7:
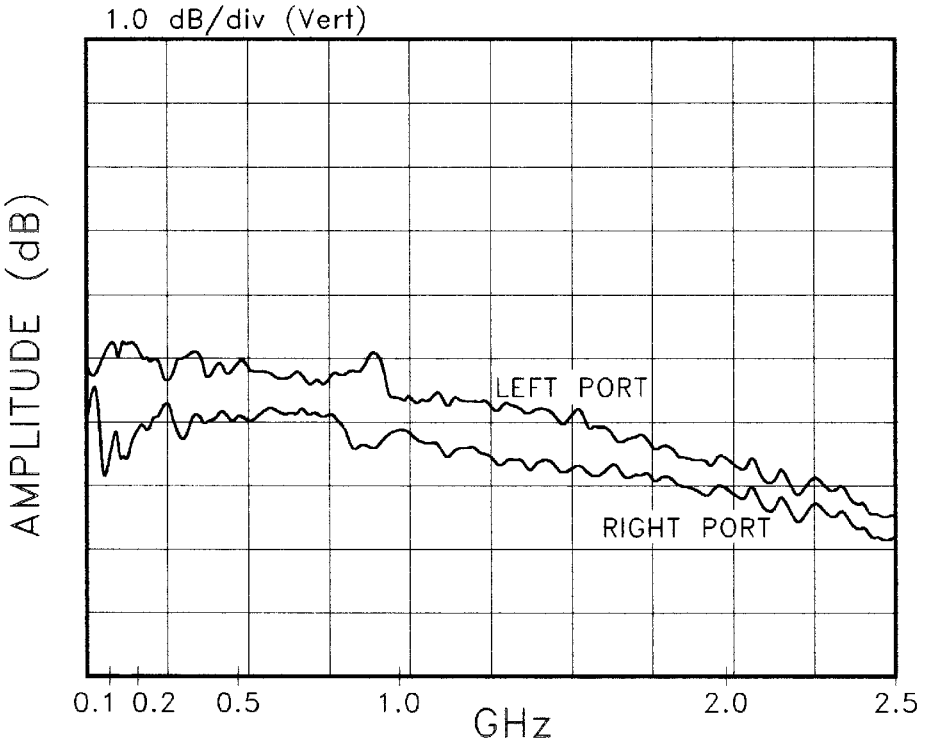
FIG. 7 is a frequency-amplitude diagram showing the measured amplitude tracking of the two ports of the preferred embodiment for the 0.05 GHz to 2.5 GHz range.
Figure 8:
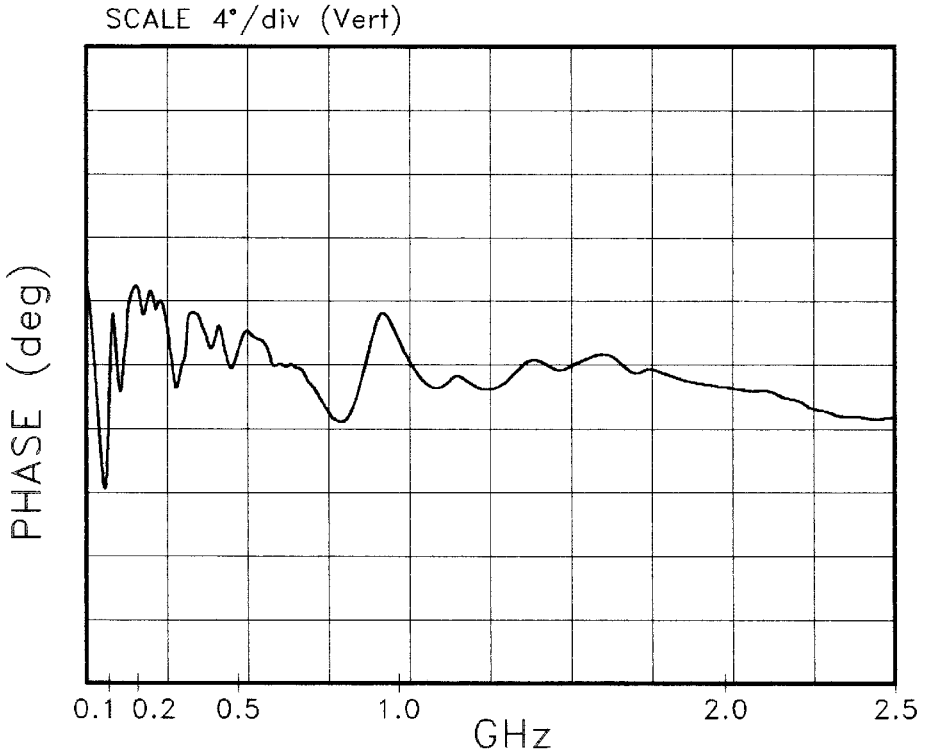
FIG. 8 is a frequency-phase diagram showing the measured phase tracking of the preferred embodiment for the 0.05 GHz to 2.5 GHz range.

FIG. 7 shows that the prototype of FIGS. 6*a* and *b* also has excellent amplitude tracking properties; with about a 1 dB loss at 1 GHz and about a 2 dB loss at 2 GHz, the amplitudes of each output were within 1 dB of each other over all of that range. Likewise, as shown in FIG. 8, the relative phase difference between the two outputs was 180°±4° over the entire 0.3 GHz to 2.5 GHz range.

Thus, the prototype balun of this invention demonstrated a usable frequency range of at least VHF through L-band frequencies. The small size of the inventive balun (the prototype described herein was about 6.6 cm×0.75 cm×2.3 cm, the largest dimension being much less than a free space wavelength over at least a 20:1 frequency bandwidth) allows it to be easily integrated into flush mounted cavities such as are commonly found in aircraft antenna installations.

It is understood that the exemplary balun described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

We claim:

1. A Guanella 1:4 balun, comprising:

a) a microwave laminate substrate;

b) a pair of microwave transmission lines printed on said substrate, each of said pair of lines including first and second parallel conductors, each of said lines being positioned on a cantilevered strip of said substrate, said strip being bendable substantially out of the plane of said substrate without damaging said lines;

c) ferrite beads separately surrounding each of said transmission lines; and d) an input terminal connected to said transmission lines in parallel;

e) one of said first conductors being connected to one of a pair of balanced output terminals at its end remote from said input, one of said second conductors being connected to the other of said pair of balanced output terminals at its end remote from said input, and the other of said first conductors being connected to the other of said second conductors.

2. The balun of claim 1, in which the largest dimension of said balun is substantially less than one free space wavelength throughout the frequency range of said balun.

3. The balun of claim 1, in which said substrate is a flexible substrate having low dielectric loss characteristics at microwave frequencies.

4. A method of fabricating a Guanella balun, comprising the steps of:

a) providing a planar flexible substrate having low dielectric loss characteristics, said substrate having a cut-out area and a cantilevered strip of substrate extending substantially across said area;

b) printing first microstrip conductors on said substrate, a portion of said conductors extending along said strip, and printing on said substrate second microstrip conductors separated from said first conductors;

c) an input terminal connected to said first and second microstrip conductors in parallel;

d) bending the free end of said strip out of the plane of said substrate;

e) threading ferrite beads over said strip from its free end;

f) bending said free end of said strip back substantially into the plane of said substrate; and g) interconnecting one of said first conductors to one of a pair of balanced output terminals at its end remote from said input, one of said second conductors being connected to the other of said pair of balanced output terminals at its end remote from said input, and the other of said first conductors being connected to the other of said second conductors in such a way as to form a Guanella transformer.

* * * * *